US009142919B2

(12) United States Patent
Osada et al.

(10) Patent No.: US 9,142,919 B2
(45) Date of Patent: Sep. 22, 2015

(54) INCOMPLETE FITTING PREVENTION CONNECTOR

(71) Applicant: Yazaki Corporation, Tokyo (JP)

(72) Inventors: Takeshi Osada, Makinohara (JP); Akihiro Tsuruta, Fujieda (JP); Nobuyuki Mukoujima, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/832,726

(22) Filed: Mar. 15, 2013

(65) Prior Publication Data

US 2013/0210266 A1 Aug. 15, 2013

Related U.S. Application Data

(63) Continuation of application No. PCT/JP2011/070621, filed on Sep. 9, 2011.

(30) Foreign Application Priority Data

Sep. 16, 2010 (JP) ..... 2010-208267

(51) Int. Cl.
*H01R 13/627* (2006.01)
*H01R 13/642* (2006.01)
(Continued)

(52) U.S. Cl.
CPC ..... *H01R 13/642* (2013.01); *H01R 13/6272* (2013.01); *H01R 13/639* (2013.01); *H01R 13/641* (2013.01)

(58) Field of Classification Search
CPC .. H01R 13/639; H01R 13/641; H01R 13/642; H01R 13/6272
USPC ..... 439/299, 350, 352, 353, 357, 378
See application file for complete search history.

(56) References Cited

U.S. PATENT DOCUMENTS 5,820,398 A * 10/1998 Stabroth et al. ..... 439/352
5,820,399 A * 10/1998 Shirouzu et al. ..... 439/352
(Continued)

FOREIGN PATENT DOCUMENTS

JP 54-177591 12/1979
JP 11-329585 A 11/1999
(Continued)

OTHER PUBLICATIONS

Search Report dated Oct. 4, 2011 issued in International Application No. PCT/JP2011/070621 (PCT/ISA/210).
(Continued)

*Primary Examiner* — Neil Abrams
*Assistant Examiner* — Travis Chambers
(74) *Attorney, Agent, or Firm* — Sughrue Mion, PLLC

(57) ABSTRACT

An incomplete fitting prevention connector includes a first connector, a second connector that is fitted to the first connector, and a connector position assurance lock that is slidably mounted to an outer side of the second connector. The first connector includes a male beak, a short spring and a terminal. The second connector includes a female lock passing over the male beak and a short-circuit removal plate part inserted between the short spring and the terminal. A draw-in slanted surface is formed at a leading end of the male beak, a restoring force for returning the female lock to its original position serves as a driving force for fitting the connector when the female lock reaches the draw-in slanted surface, and the insertion force of the short-circuit removal plate part applied between the short spring and the terminal is reduced.

4 Claims, 7 Drawing Sheets

(51) Int. Cl.
*H01R 13/639* (2006.01)
*H01R 13/641* (2006.01)

(56) References Cited

U.S. PATENT DOCUMENTS

| | | | | |
|---|---|---|---|---|
| 6,533,600 | B1 * | 3/2003 | Kashiyama et al. | 439/352 |
| 6,659,789 | B2 * | 12/2003 | Nagamine et al. | 439/352 |
| 6,685,500 | B2 * | 2/2004 | Nakamura | 439/489 |
| 7,008,258 | B2 * | 3/2006 | Nakamura | 439/489 |
| 7,559,787 | B2 * | 7/2009 | Shigeta et al. | 439/358 |
| 2004/0185700 | A1 | 9/2004 | Endo et al. | |

FOREIGN PATENT DOCUMENTS

| | | | | | |
|---|---|---|---|---|---|
| JP | 2000-077139 | A | | 3/2000 | |
| JP | 2000077139 | A | * | 3/2000 | H01R 13/64 |
| JP | 2004-006119 | A | | 1/2004 | |
| JP | 2004-241275 | A | | 8/2004 | |
| JP | 2005-190985 | A | | 7/2005 | |
| JP | 2007-128743 | A | | 5/2007 | |
| JP | 2008-159365 | A | | 7/2008 | |
| JP | 2008159365 | A | * | 7/2008 | |
| JP | 2009-043648 | A | | 2/2009 | |
| WO | WO 2010115750 | A1 | * | 10/2010 | H01R 13/703 |

OTHER PUBLICATIONS

Written Opinion dated Oct. 4, 2011 issued in International Application No. PCT/JP2011/070621 (PCT/ISA/237).

Office Action, dated May 29, 2014, issued by the Korean Intellectual Property Office in counterpart Korean Application No. 10-2013-7005988.

Japanese Office Action, Application No. 2010-208267; Aug. 4, 2014.

Office Action dated Oct. 21, 2014, issued by the State Intellectual Property Office of P.R. China in counterpart Chinese Application No. 201180044863.3.

Chinese Office Action Application No. 20118044863.3; Jun. 15, 2015.

Australian Patent Examination Report; Application No. 2011304518; Jun. 29, 2015.

* cited by examiner

-- Related Art --

-- Related Art --

INCOMPLETE FITTING PREVENTION CONNECTOR

CROSS REFERENCE TO RELATED APPLICATION

This application is a continuation of PCT application No. PCT/JP2011/070621, which was filed on Sep. 9, 2011 based on Japanese Patent Applications No. 2010-208267 filed on Sep. 16, 2010, the contents of which are incorporated herein by reference. Also, all the references cited herein are incorporated as a whole.

BACKGROUND OF THE INVENTION

1. Technical Field

The present invention relates to an incomplete fitting prevention connector and, more particularly, to a connector which includes a short spring or a packing and has an incomplete fitting prevention function.

2. Background Art

A connector is known which includes an incomplete fitting prevention function to detect an incomplete fitting state between a male connector housing and a female connector housing (for example, see JP-A-2004-241275).

Object and Configuration of the Invention Disclosed in JP-A-2004-241275

The invention disclosed in JP-A-2004-241275 is intended to prevent a working error such as an incomplete fitting when a fitting detecting member slides relative to a female connector housing and the female connector housing is pressed by a finger of an operator conducting the fitting operation. Specifically, the invention disclosed in JP-A-2004-241275 includes a connector housing having a flexible lock arm and a fitting detecting member having a cylindrical detecting member body slidably fitted to an outer periphery of the connector housing along a fitting direction and a positioning lock part to regulate the detecting member body at its initial position by engagement with the flexible lock arm. The fitting detecting member is formed with a finger pad which can be supported so as not to press at least the flexible arm lock of the connector housing when fitting the connector.

Problem of the Invention Disclosed in JP-A-2004-241275

The connector disclosed in JP-A-2004-241275 includes only a CPA (connector position assurance lock) and a packing and therefore exhibits an effect of the above-described incomplete fitting prevention function. However, in a case where a configuration including a short spring is additionally provided to the connector, there was a matter that the insertion force becomes greater when inserting a short-circuit removal plate part to the short spring.

Further, there was a matter that the insertion force becomes greater also when a number of the terminal is plural number.

SUMMARY OF THE INVENTION

The present invention has been made to solve the above-described matters and an object of the present invention is to provide an incomplete fitting prevention connector which is capable of preventing increase in the insertion force even when a connector including a CPA and a packing further includes a short spring and also preventing the increase in the insertion force even when a terminal is a number of the terminal is plural number.

(1) According to an aspect of the invention, an incomplete fitting prevention connector includes a first connector, a second connector that is fitted to the first connector, and a connector position assurance lock (CPA) that is slidably mounted to an outer side of the second connector. The first connector includes a male beak, a short spring and a terminal. The second connector includes a female lock passing over the male beak and a short-circuit removal plate part inserted between the short spring and the terminal. A draw-in slanted surface is formed at a leading end of the male beak, a restoring force for returning the female lock to its original position serves as a driving force for fitting the connector when the female lock reaches the draw-in slanted surface, and the insertion force of the short-circuit removal plate part applied between the short spring and the terminal is reduced.

(2) In the incomplete fitting prevention connector of (1), the CPA includes a CPA lock passing over the male beak and the female lock and a leading-end slanted surface is formed at a leading end of the female lock and one-action property is secured by using a restoring force for returning the CPA lock to its original position as the driving force when the CPA lock reaches the leading-end slanted surface.

According to the incomplete fitting prevention connector having a configuration of the above (1), the insertion force is not very great and it is possible to obtain an incomplete fitting prevention function, even when the connector including the CPA and the packing further includes the short spring. In addition, an incomplete fitting prevention is satisfied.

According to the incomplete fitting prevention connector having a configuration of the above (2), it is possible to secure one-action property by using the restoring force for returning the CPA lock to its original position as the driving force when the CPA lock reaches the leading-end slanted surface.

BRIEF DESCRIPTION OF DRAWINGS

FIG. 9A is a longitudinal sectional view explaining a shape of a female lock 20L according to the present embodiment and FIG. 9B is a longitudinal sectional view explaining a shape of a female lock 20L' in a conventional product.

DESCRIPTION OF EMBODIMENTS

Hereinafter, with reference to the drawings, an incomplete fitting prevention connector according to an exemplary embodiment of the present invention will be described which is capable of preventing increase in the insertion force and satisfying an incomplete fitting prevention function, even when the connector includes a short spring and further even when a number of the terminal is plural number.

<Three Components of an Incomplete Fitting Prevention Connector According to an Exemplary Embodiment of the Present Invention>

Figure 1:
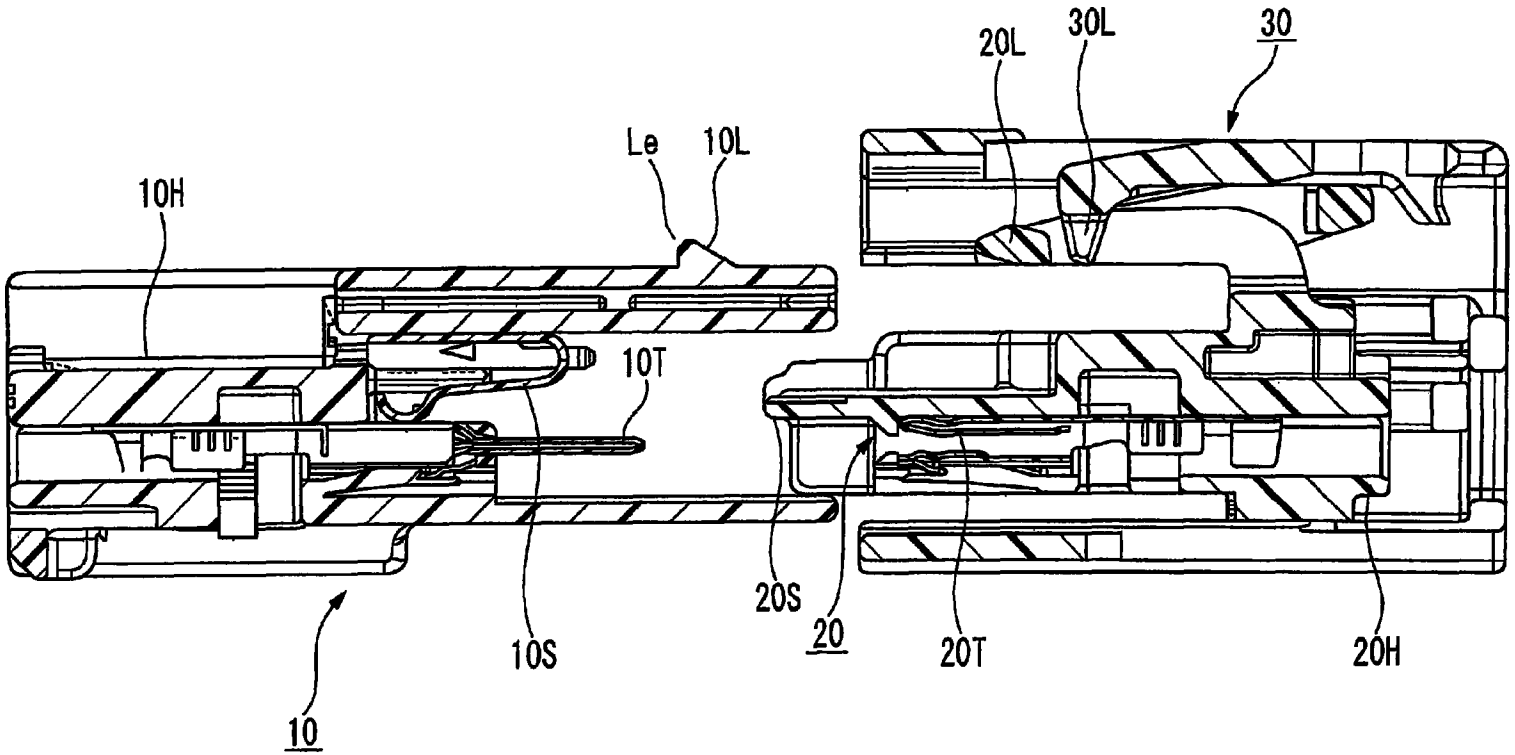
FIG. 1 is a longitudinal sectional view showing a male connector and a female connector according to an exemplary embodiment of the present invention before fitting.

FIG. 1 is a longitudinal sectional view showing a male connector and a female connector according to an exemplary embodiment of the present invention before fitting. An incomplete fitting prevention connector according to the present embodiment mainly includes a first connector (for example, a male connector) 10, a second connector (for example, a female connector) 20 fitted to the first connector and a connector position assurance lock (hereinafter, referred to as a "CPA") 30 slidably mounted to an outer side of the male connector 20.

Hereinafter, the male connector 10, the female connector and the CPA 30 will be sequentially described.

<Configuration of Male Connector 10>

The male connector 10 includes a male housing 10H, a male connector terminal (terminal) 10T provided in an interior space of the male housing 10H and a short spring 10S which is capable of being connected to or disconnected from the male connector terminal 10T.

<<Male Housing 10H>>

The male housing 10H is provided with a male beak 10L which has a longitudinal section in the form of a saw-toothed projection. A female lock 20L passes over the male beak 10L to be locked thereto.

<Function of Male Beak 10L>

Figure 8A:
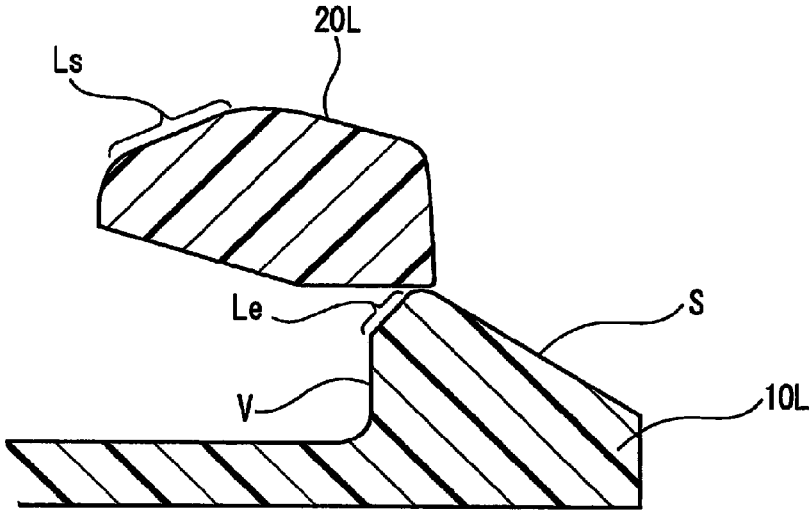
FIG. 8A is a longitudinal sectional view explaining a shape of a male beak 10L according to the present embodiment and FIG. 8B is a longitudinal sectional view explaining a shape of a male beak 10L' in a conventional product.
Figure 8B:
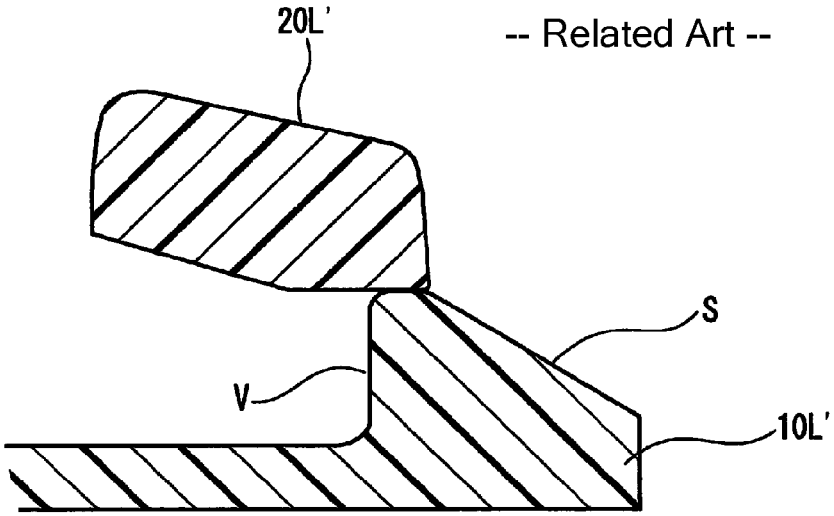

A male beak 10L' having a shape as shown in FIG. 8B is known in a related art.

FIG. 8A is a longitudinal sectional view explaining a shape of the male beak 10L according to the present embodiment and FIG. 8B is a longitudinal sectional view explaining a shape of the male beak 10L' in a conventional product. The male beak 10L' (see FIG. 8B) in the conventional product includes a slanted surface S and a vertical surface V. The female lock 20L' passes over the slanted surface S and then is locked to the vertical surface V.

The slanted surface S is a slanted surface that is intended to return the connector to its original position by a repulsive force of the female lock 20L' when an action of an operator is removed in a state (in an incomplete-fitting state) before the female lock 20L' passes over the slanted surface. By this configuration, an incomplete-fitting is prevented.

As the female lock 20L' passes over the slanted surface S, the female lock 20L' is locked to the vertical surface V and thus the connector does not return to its original position again (complete-fitting state), even when an action of an operator is removed. Since the male beak 10L' in the conventional product includes the slanted surface S and the vertical surface V, an incomplete fitting prevention function is obtained.

The male beak 10L (see FIG. 8A) of the present embodiment includes a slanted surface S and a vertical surface V, as in the conventional product. The female lock 20L passes over the slanted surface S and then is locked to the vertical surface V. Accordingly, an incomplete fitting prevention function is obtained.

In addition, the male beak 10L of the present embodiment is characterized by including a draw-in slanted surface Le.

<<Draw-in Slanted Surface Le>>

As shown in FIG. 8A, the draw-in slanted surface Le is a slanted surface which is formed toward the vertical surface V from the slanted surface S near the intersection of the vertical surface V and the slanted surface S over which the female lock 20L passes. As the female lock 20L reaches the draw-in slanted surface Le, a restoring force for returning the female lock 20 to its original position is generated and serves as a driving force, so that a function to reduce a connector insertion force is achieved. This function will be described again after description of the short spring 10S.

<<Male Connector Terminal 10T>>

Figure 7:
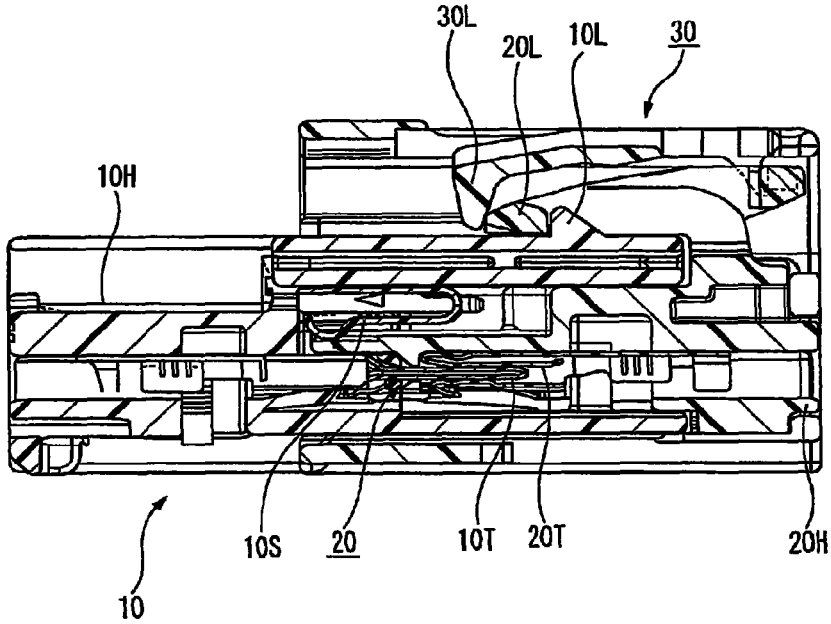
FIG. 7 is a longitudinal sectional view showing the connectors when a complete fitting is finished.

In a state where the male connector 10 is fitted to the mating female connector 20, a male connector terminal 10T (see FIG. 1) is inserted between female connector terminals 20T of the female connector 20 (see FIG. 1) and thus electrical connection is established (see FIG. 7). At this time, frictional contact between these connector terminals occurs and thus an insertion force is required.

Figure 10A:
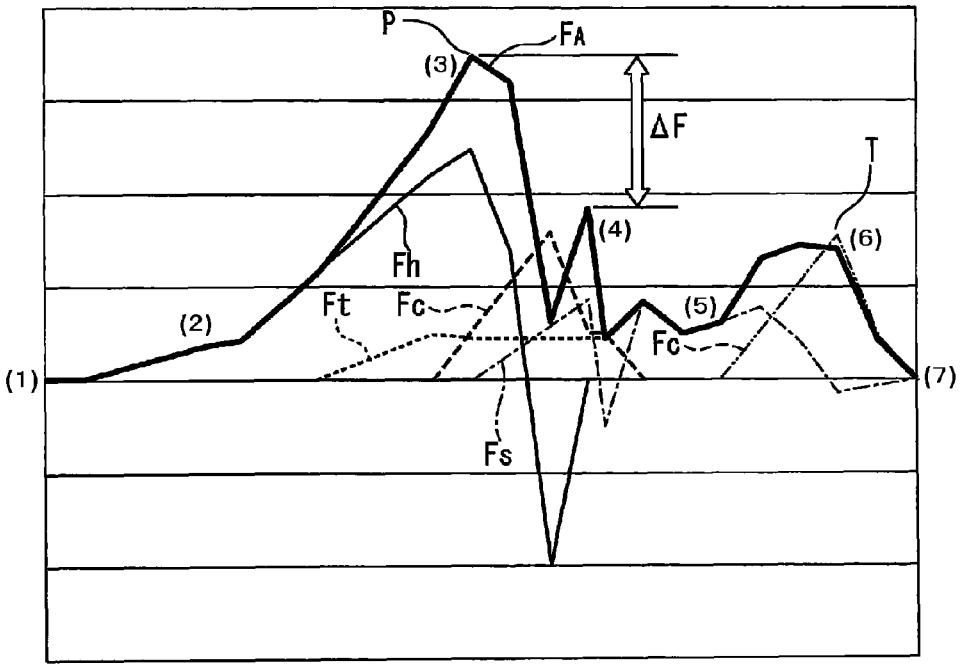
FIG. 10A is a graph showing the change in the insertion force of each part of a connector according to the present embodiment from start to end of fitting and FIG. 10B is a graph showing the change in the insertion force of each part of a conventional connector from start to end of fitting.
Figure 10B:
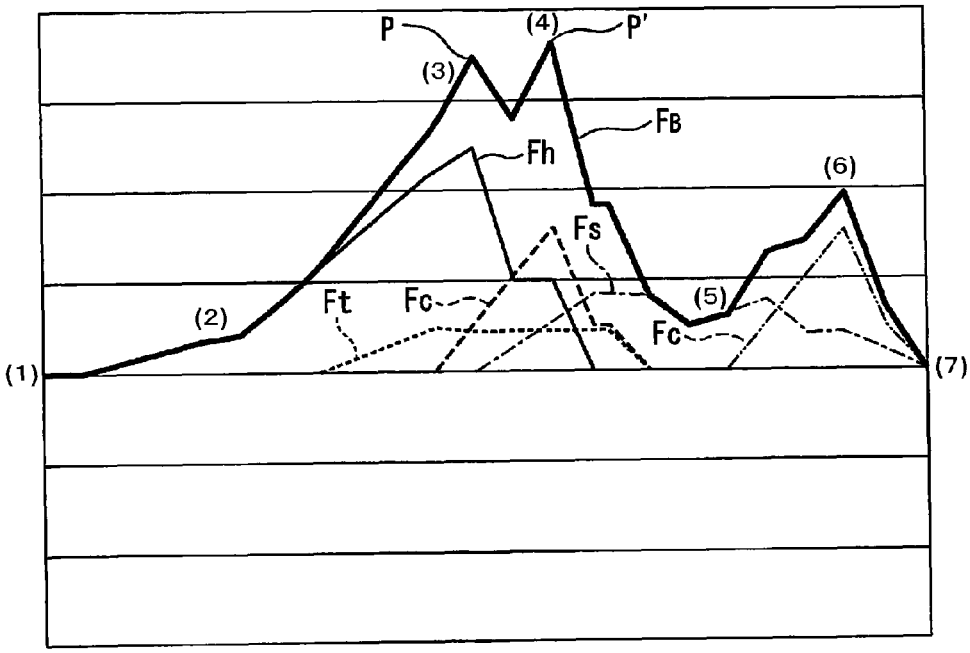

FIG. 10A is a graph showing the change in the insertion force of each part of the connector according to the present embodiment from start to end of fitting and FIG. 10B is a graph showing the change in the insertion force of each part of the conventional connector from start to end of fitting. Insertion force of the connector terminal is represented as Ft. The insertion force Ft of the connector terminal exhibits the same transition in both the connector according to the present embodiment and the conventional connector. That is, the insertion force Ft is first gradually increased, maintained constant from a certain region and finally becomes zero.

<<Short Spring 105>>

Although the short spring 10S is brought into contact with the male connector terminal 10T in a state (see FIG. 1) where the male connector 10 is not fitted to the female connector 20, a short-circuit removal plate part 20S of the female connector 20 is inserted between the short spring 10S and the male connector terminal 10T and therefore the short spring 10S is disconnected from the male connector terminal 10T in a state (for example, see FIG. 7) where the male connector 10 is fitted to the mating female connector 20.

A large insertion force is required when the short-circuit removal plate part 20S is inserted between the short spring 10S and the male connector terminal 10T. In FIGS. 10A and 10B, the insertion force of the short spring is represented as Fs. The insertion force Fs of the short spring exhibits the same transition in both the connector according to the present embodiment and the conventional connector according to the related art. That is, the insertion force Fs is first abruptly increased, abruptly decreased at a peak and finally becomes zero.

According to the present embodiment, an inertial force (which will be described later) is generated in a direction to cancel the abruptly increasing insertion force when the insertion force Ft of the connector terminal is abruptly increased in such a way. Accordingly, the entire insertion force can be decreased, as compared to the conventional product.

<Configuration of Female Connector 20>

The female connector 20 includes a female housing 20H and a female connector terminal 20T provided in an interior space of the female housing 20H. The CPA 30 is slidably mounted to an outer side of the female housing 20H.

<<Female Housing 20H>>

The female housing 20H is inserted to the interior space of the male housing 10H and thus fitted to the male housing 10H. In FIGS. 10A and 10B, the insertion force between these housings is represented as Fh. The insertion force Fh between these housings is largely increased from the beginning and reaches a peak. This insertion force is the same until reaching the peak in FIGS. 10*a* and 10B. After reaching the peak, the insertion force in the connector according the present embodiment is greatly different from the insertion force in the conventional connector (which will be described later).

Further, the female housing 20H is provided with the following female lock 20L in a cantilevered state.

<<Female Lock 20L>>

A leading end of the female lock 20L provided in the cantilevered state passes over the slanted surface of the male beak 10L which is provided in the male housing 10H and has a saw-toothed longitudinal section. After finally passing over the slanted surface, the leading end is locked to the vertical surface of the male beak 10L.

Figure 3:
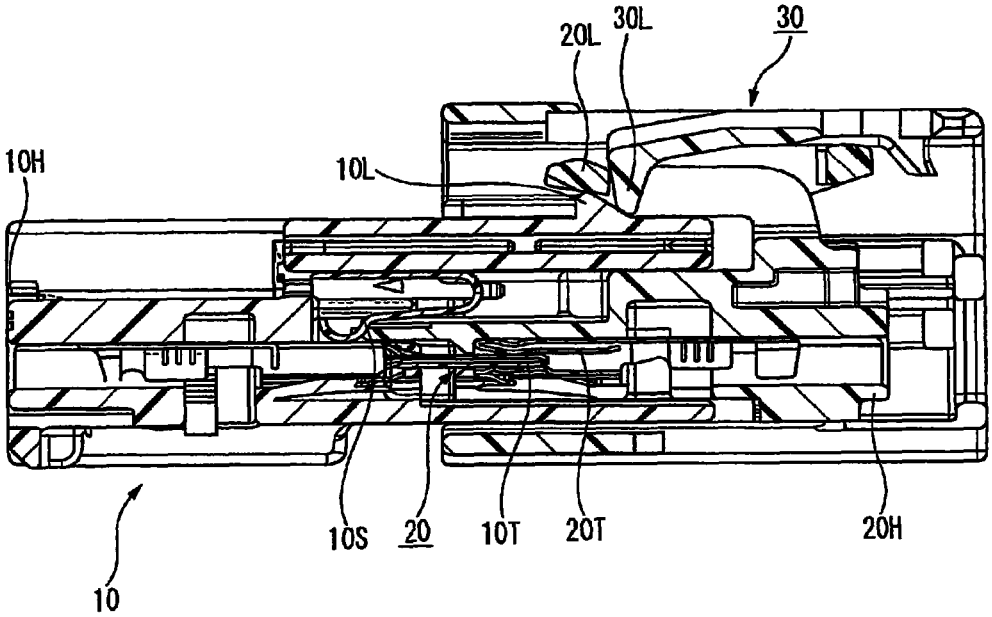
FIG. 3 is a longitudinal sectional view showing the connectors in the middle of fitting.
Figure 4:
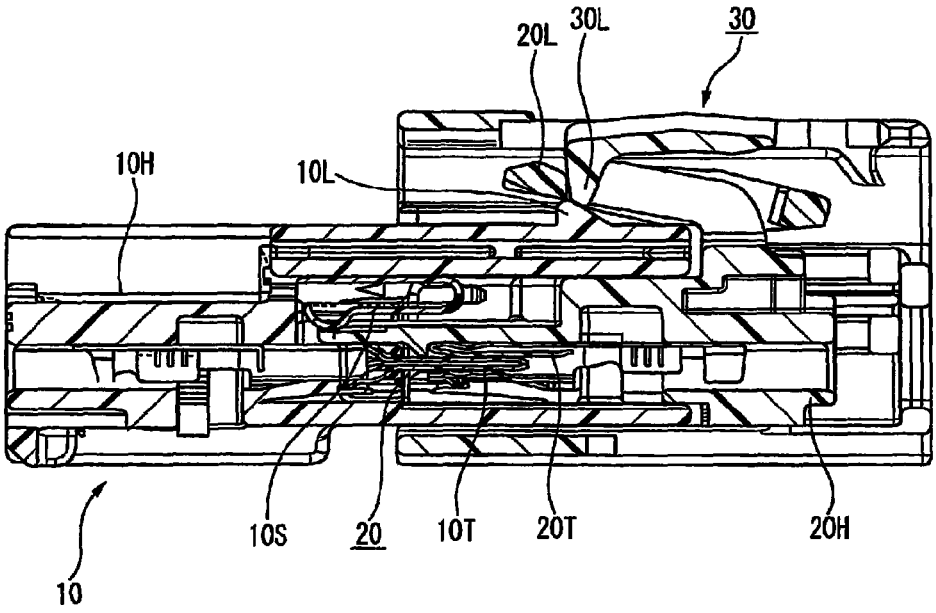
FIG. 4 is a longitudinal sectional view showing the connectors when a female lock reaches a draw-in slanted surface.

The connector returns to its original position by a repulsive force of the female lock 20L when an action of an operator is removed in a state (see FIG. 3 in an incomplete-fitting state) where the female lock 20L tries to pass over the slanted surface S of the male beak 10L (incomplete fitting prevention function). As the female lock 20L passes over the slanted surface S, the female lock is locked to the vertical surface V and the connector does not return to its original position again (see FIG. 4 in an complete-fitting state), even when an action of an operator is removed.

<Cooperation Function Between Draw-in Slanted Surface Le of Male Beak 10L and Female Lock 20L>

When the female lock 20L (see FIG. 8A) reaches the draw-in slanted surface Le (see FIG. 8A) formed in the present embodiment, a restoring force for returning the female lock 20L to its original position serves as a driving force and thus cancels a large insertion force required in the insertion of the short spring 10S.

<<Shape of Female Lock 20L According to the Present Embodiment>>

Further, a slanted surface is formed on a leading end of the female lock 20L by the present embodiment.

Figure 9A:
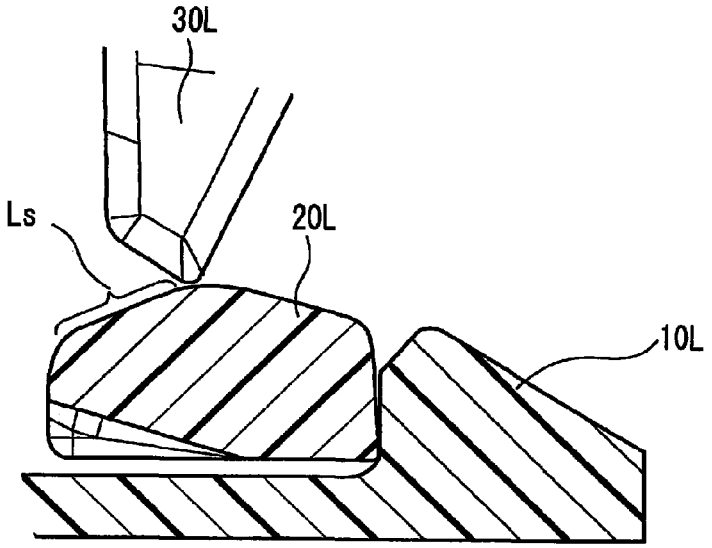
FIGS. 9A and 9B are a longitudinal sectional view explaining a shape of the female lock.
Figure 9B:
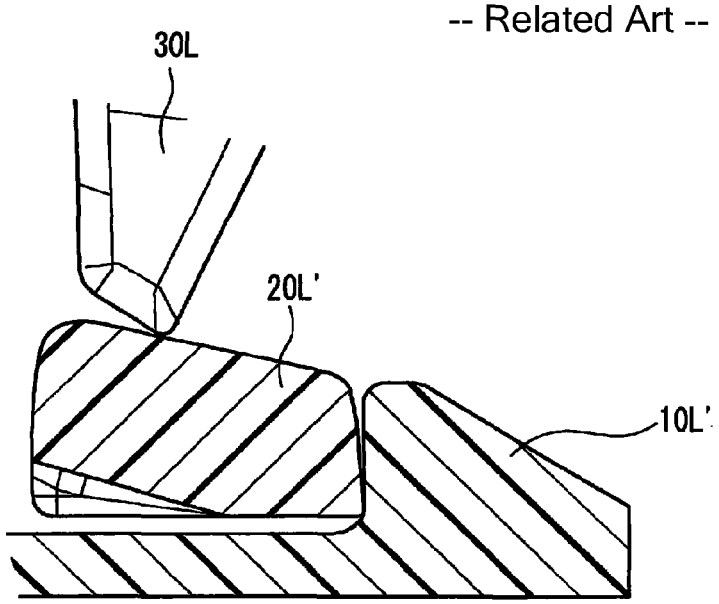

FIG. 9A is a longitudinal sectional view explaining a shape of the female lock 20L according to the present embodiment and FIG. 9B is a longitudinal sectional view explaining a shape of the female lock 20L' in a conventional product. The female lock 20L' in the conventional product has an angular leading end in a fitting direction, whereas the female lock 20L according to the present embodiment has a characteristic that the leading-end slanted surface Ls having a slanted leading end is formed, as shown in FIG. 9A. As the CPA lock 30L reaches the leading-end slanted surface Ls, a restoring force for returning the CPA lock 30L to its original position is generated and serves as a driving force, and a function to reduce a connector insertion force is achieved. This function will be described again after the description of the CPA lock 30L.

<<Female Connector Terminal 20T>>

The female connector terminal 20T (see FIG. 1) has a structure of two terminals facing to each other for inserting the male connector terminal 10T of the male connector 10 therebetween. Accordingly, in a state where the male connector 10 is fitted to the female connector 20, the male connector terminal 10T is inserted between the female connector terminals 20T (see FIG. 1) and thus electrical connection is established (see FIG. 7). The insertion force Ft between these connector terminals has been already described above.

<Configuration of CPA 30>

The female lock 20L passes over the male beak 10L to be locked thereto in a state where the male connector 10 and the female connector 20 are fitted to each other. In this case, the CPA 30 is provided in order to prevent the female lock 20L from being detached from the locking with the male beak 10L at any moment. The CPA lock 30L covers the top of the female lock 20L to suppress the return of the female lock.

<Cooperation Function Between Leading-End Slanted Surface Ls of Female Lock 20L and CPA Lock 30L>

As described in FIG. 9A, the female lock 20L is provided with the leading-end slanted surface Ls in order to prevent load from increasing at a part away from a fitting peak. As the CPA lock 30L reaches the leading-end slanted surface Ls, a restoring force for returning the CPA lock 30L to its original position serves as a driving force to secure one-action property.

On the contrary, since the leading-end slanted surface Ls is not provided and an upward slanted surface is continued in the conventional product of FIG. 9B, a large insertion force is required when the CPA lock 30L goes up the upward slanted surface of the female lock 20L and two-step insertion feeling occurs. For this reason, one-action property is not obtained. Accordingly, smooth insertion is not obtained.

<Change in Total Insertion Force of Connector According to the Present Embodiment>

With summarizing the above descriptions, the change in total insertion force of the connector according to the present embodiment from start to end of fitting is described by referring to the graph of FIG. 10A.

FIG. 10A is a graph showing the change in the total insertion force of the connector according to the present embodiment from start to end of fitting. Fh represents the change in the insertion force of the housing, Ft represents the change in the insertion force of the connector terminal, Fc represents the change in the insertion force of the CPA lock and Fs represents the change in the insertion force of the short spring. Further, FIG. 10B is a graph showing the change in the total insertion force of the conventional connector from start to end of fitting.

<<(1) Before Fitting>>

This state refers to a state where the male connector 10 and the female connector 20 are still separated from each other (see FIG. 1).

<<(2) at the Start of Fitting: Only the Insertion Force Fh>>

Figure 2:
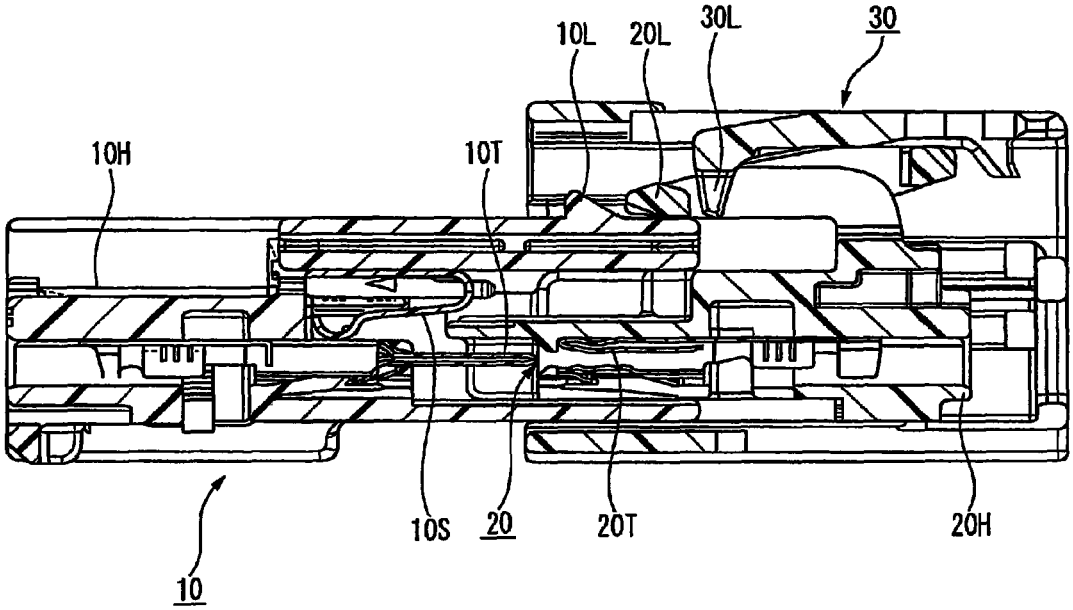
FIG. 2 is a longitudinal sectional view showing the connectors at the start of fitting.

Since the male connector terminal 10T is not yet inserted to the female connector terminals 20T at the start of fitting the housings to each other (see FIG. 2), the insertion force Ft of the connector terminal does not occur and only the insertion force Fh of the housing due to the friction between the male housing 10H and the female housing 20H is increased. Accordingly, the total insertion force only includes the insertion force Fh of the housing.

<<(3) in the Middle of Fitting: Incomplete Fitting Prevention Function>>

As the fitting is continuously performed (see FIG. 3), the female lock 20L reaches the male beak 10L to be lifted up. As the insertion of the male connector terminal 10T to the female connector terminal 20T is started and this insertion proceeds, the frictional force is increased and the insertion force Ft of the connector terminal is increased.

Further, the insertion force Fc of the CPA lock is still small in a state where the CPA lock 30L just reaches the male beak 10L. However, the insertion force Fc of the CPA lock is abruptly increased from that state.

At this time, when an action of an operator is removed, the female connector 20 returns to its original position by a large repulsive force of the female lock 20L (incomplete fitting prevention). This incomplete fitting prevention function is a conventional technique.

<<(4) Female Lock 20L Reaches Draw-in Slanted Surface Le: The Insertion Force Fs of the Short Spring is Cancelled>>

As the fitting is further performed (see FIG. 4), the female lock 20L completely goes up the male beak 10L and reaches the draw-in slanted surface (see FIG. 8A) provided by the present embodiment. Then, a restoring force for returning the female lock 20L to its original position serves as a driving force for fitting the connector and therefore the insertion force Ft of the housing is largely directed toward a negative direction, so that the insertion force Ft of the connector terminal and the insertion force Fs of the short spring are cancelled during that time. A function for canceling the insertion force Fs of the short spring corresponds to an effect "A" of the present invention.

On the contrary, in the male beak 10L' (see FIG. 8B) of the conventional product without the draw-in slanted surface, a force for returning the female lock 20L to its original position is not generated and therefore a peak P' of the total insertion force FB becomes higher than a previous peak P.

<<(5) Female Lock 20L is Engaged with a Leading End of Male Beak 10L>>

Figure 5:
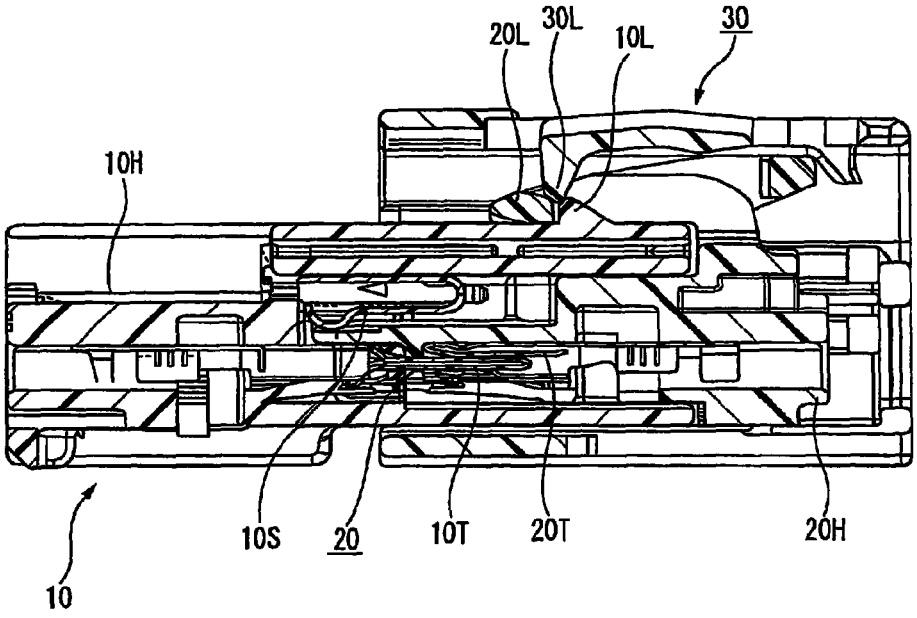
FIG. 5 is a longitudinal sectional view showing the connectors when the female lock is engaged with a leading end of a male beak.

As the fitting is further performed (see FIG. 5), the CPA lock 30L is moved forward by an inertial force occurring when the female lock 20L is engaged with a leading end of the male beak 10L and thus completely goes up the male beak 10L. A technique which prevents the incomplete-fitting by causing the CPA lock 30L to go up the male beak 10L by the inertial force in this way is also a conventional technique.

<<(6) CPA Lock 30L Reaches Leading-End Slanted Surface Ls: One-Action Property>>

Figure 6:
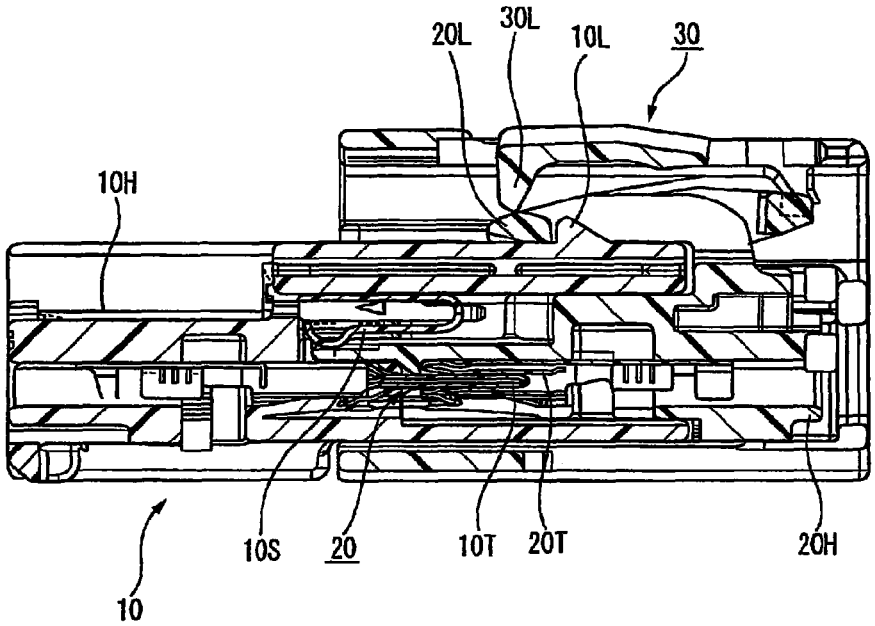
FIG. 6 is a longitudinal sectional view showing the connectors when a CPA lock reaches a leading-end slanted surface.

As the fitting is further performed (see FIG. 6), the CPA lock 30L reaches the leading-end slanted surface Ls (see FIG. 8A) which is provided on the female lock 20L in the present embodiment in order to prevent load from increasing at a part T (see FIG. 10A) away from a peak P (see FIG. 10A). At this time, a restoring force for returning the CPA lock 30L to its original position is generated and serves as a driving force to largely reduce the insertion force Fc of the CPA lock in a negative direction. In this way, the total insertion force FA is suppressed to a lower level and one-action property is secured. The secure of the one-action property is an effect "B" of the present invention.

On the contrary, in the female lock 20L' (see FIG. 8B) of the conventional product without the leading-end slanted surface Ls, a force for returning the CPA lock 30L to its original position is not generated. For this reason, the total insertion force FA is increased and the property becomes two actions. Accordingly, smooth insertion is not performed.

<<(7) Fitting Completion>>

In this way, the incomplete-fitting is excluded and the complete-fitting is finished (see FIG. 7).

Hereinabove, according to the present embodiment, by providing the draw-in slanted surface Le, a restoring force for returning the female lock reaching the draw-in slanted surface Ls to its original position is generated and serves as a driving force to reduce the insertion force of the short spring during short-circuit removal, even when the short spring is further provided to the connector including the connector position assurance lock (CPA) and the packing and also even when a number of the terminal is a plural number. Accordingly, the entire insertion force is not very great and also the same incomplete fitting prevention function as the related art is achieved.

Further, according to the present embodiment, by providing the leading-end slanted surface Ls, a restoring force for returning the CPA lock reaching the leading-end slanted surface Ls to its original position serves as a driving force and thus one-action property is obtained.

Herein, the above-described exemplary embodiments merely illustrate the representative forms of the present invention and the present invention is not limited to the exemplary embodiments. That is, the exemplary embodiments may be variously modified without departing a spirit and a scope of the present invention.

INDUSTRIAL APPLICABILITY

As described above, according to the incomplete fitting prevention connector of the present invention, it is possible to suppress increase in the insertion force and obtain the incomplete fitting prevention function, even when the connector including the connector position assurance lock (CPA) and the packing further includes the short spring and also even when a number of the terminal is plural number.

REFERENCE SIGNS LIST

10 Male Connector (First Connector)
10L Male Beak
10S Short Spring
10T Male Connector Terminal (Terminal)
20 Female Connector (Second Connector)
20L Female Lock
20S Short-Circuit Removal Plate Part
20T Female Connector Terminal
30 Connector Position Assurance Lock (CPA)
30L CPA Lock
Le Draw-In Slanted Surface
Ls Leading-End Slanted Surface

What is claimed is:

1. An incomplete fitting prevention connector comprising:
a first connector;
a second connector that is fitted to the first connector; and
a connector position assurance lock (CPA) that is slidably mounted to an outer side of the second connector,
wherein the first connector includes a male beak, a short spring and a terminal,
the second connector includes a female lock which passes over the male beak and a short-circuit removal plate part inserted between the short spring and the terminal, and
a draw-in slanted surface is formed at a leading end of the male beak,
a restoring force for returning the females lock to its original position serves as a driving force for fitting the connector when the female lock reaches the draw-in slanted surface, and the insertion force of the short-circuit removal plate part applied between the short spring and the terminal is reduced.

2. The incomplete fitting prevention connector according to claim 1, wherein the CPA includes a CPA lock passing over the male beak and the female lock and,
a leading-end slanted surface is formed at a leading end of the female lock and one-action property is secured by using a restoring force for returning the CPA lock to its original position as the driving force when the CPA lock reaches the leading-end slanted surface.

3. The incomplete fitting prevention connector according to claim 1, wherein a vertical surface of the male beak abuts a vertical surface of the female lock while the connector is fit.

4. An incomplete fitting prevention connector comprising:

a first connector;

a second connector that is fitted to the first connector by moving the first connector in a fitting direction with respect to the second connector; and a connector position assurance lock (CPA) that is slidably mounted to an outer side of the second connector, wherein the first connector includes a male beak, a short spring and a terminal, the second connector includes a female lock which passes over the male beak and a short-circuit removal plate part inserted between the short spring and the terminal, and a draw-in slanted surface is on a back side of the male beak, opposite the fitting direction, wherein a restoring force for returning the females lock to its original position serves as a driving force for fitting the first connector with the second connector when the female lock contacts the draw-in slanted surface, such that an insertion force for inserting the short-circuit removal plate part between the short spring and the terminal is reduced, wherein the CPA includes a CPA lock passing over the male beak and the female lock and, a leading-end slanted surface is formed at a leading end of the female lock and one-action property is secured by using a restoring force for returning the CPA lock to its original position as the driving force when the CPA lock reaches the leading-end slanted surface.

* * * * *